US006003201A

United States Patent [19]

Ryczek

[11] Patent Number: 6,003,201

[45] Date of Patent: Dec. 21, 1999

[54] DOOR PARKING LOCATOR

[75] Inventor: William F. Ryczek, Glendora, Calif.

[73] Assignee: Arthur Cox & Sons, Inc., City of Industry, Calif.

[21] Appl. No.: 08/876,138

[22] Filed: Jun. 13, 1997

[51] Int. Cl.[6] ..... E05C 17/54; E05C 17/62

[52] U.S. Cl. ..... 16/87 R; 16/96 R; 16/DIG. 20; 292/75; 292/DIG. 36; 49/449

[58] Field of Search ..... 16/35 R, 87 R, 16/90, 91, 96 R, DIG. 20, 82, 97, DIG. 32; 49/449–451, 407, 425; 292/DIG. 32, DIG. 46, 75, 193, DIG. 36

[56] References Cited

U.S. PATENT DOCUMENTS

| | | | |
|---|---|---|---|
| 515,248 | 2/1894 | Phipps | 16/DIG. 20 |
| 556,572 | 3/1896 | Bataille | 16/87 R |
| 923,628 | 6/1909 | Costello, Jr. | 49/451 |
| 1,038,111 | 9/1912 | Foss | 292/75 |
| 2,064,830 | 12/1936 | Hanson . | |
| 2,218,149 | 10/1940 | Haynes . | |
| 2,519,011 | 8/1950 | Aurandt | 16/97 |
| 2,539,064 | 1/1951 | Ernest | 16/96 R |
| 2,650,387 | 9/1953 | Foss . | |
| 2,786,240 | 3/1957 | Tobiasz | 49/425 |
| 2,866,663 | 12/1958 | Ashford | 49/451 |
| 2,990,566 | 7/1961 | Lee | 16/87 R |
| 3,167,112 | 1/1965 | Tucker . | |
| 3,750,337 | 8/1973 | Brydolf et al. | 49/411 |
| 4,189,173 | 2/1980 | Rester | 49/449 |
| 4,193,500 | 3/1980 | Scott | 206/577 |
| 4,262,451 | 4/1981 | Dallaire | 49/425 |
| 4,337,988 | 7/1982 | Schench | 16/35 R |
| 4,478,006 | 10/1984 | Johnson, Jr. | 49/410 |
| 4,733,499 | 3/1988 | Guddas | 49/450 |
| 4,819,297 | 4/1989 | Jacobs et al. | 16/87 |
| 4,923,346 | 5/1990 | Hager | 16/44 |
| 5,165,142 | 11/1992 | Pilsbury | 16/91 |

FOREIGN PATENT DOCUMENTS

| | | | |
|---|---|---|---|
| 1534797 | 9/1969 | Germany | 49/425 |
| 188228 | 11/1922 | United Kingdom . | |

*Primary Examiner*—Chuck Y. Mah
*Assistant Examiner*—Donald M. Gurley
*Attorney, Agent, or Firm*—Knobbe, Martens, Olson & Bear, LLP

[57] ABSTRACT

A method and apparatus for counteracting the effects of warpage, distortion and/or tilting of a support track in a sliding closure assembly, such that a door in the sliding closure may be freely moved along the support track, but, when desired, may be secured in one or more locations such that an external force is required to move the sliding fixture from its desired position.

29 Claims, 10 Drawing Sheets

DOOR PARKING LOCATOR

BACKGROUND OF THE INVENTION

This invention relates to sliding doors or other such closure assemblies, and more particularly to an insert for the support track of a sliding closure assembly.

It is now commonplace to employ bypass doors for a wide variety of applications, including door, window, and cabinet closures. Bypass doors are often commonly referred to as sliding closure assemblies or sliding doors, even though the supporting mechanism most often employs wheels.

While various designs and combinations of sliding closures are currently used, including single or multiple track sliding fixtures, virtually all sliding closure designs incorporate at least one sliding element or door that functions to close an opening when in the proper position. All sliding closures require some type of support for the sliding door elements that they incorporate. Numerous methods of support for such doors are well known in the art, such as the bottom-supported assembly disclosed in U.S. Pat. No. 4,262,451 to Dallaire, the top-supported hanging assembly disclosed in U.S. Pat. No. 3,750,337 to Brydolf, et al, the side-supported assemblies disclosed in U.S. Pat. No. 2,218,149 to Haynes, U.S. Pat. No. 2,064,830 to Hanson, and U.S. Pat. No. 3,167,112 to Tucker, or a combination of such supports as disclosed in U.S. Pat. No. 4,819,297 to Jacobs, et al, and U.S. Pat. No. 4,193,500 to Scott. These assemblies all incorporate at least one wheel assembly which travels in a support track, supporting the weight of the sliding door. As the door travels along the support track, rotation of the wheel in the wheel assembly minimizes frictional forces in the system, allowing smooth and unimpeded movement of the door.

Because it is desirous for the operator of a sliding closure to be able to easily move the doors, top and bottom support sliding closures are typically constructed to minimize frictional forces opposing motion along the support track. This allows the operator to easily move the door to a desired location with a minimum of effort. For these types of supports, it is most desirable that the support track be at or near a level plane (essentially horizontal). When properly constructed, any horizontal forces acting on the door resulting from gravitational attraction will be minimized, allowing the frictional forces inherent in the support system for the door to overcome such minimal horizontal forces, thus maintaining the door in its resting position absent operator intervention.

However, where there is poor construction, settling of a building and/or movement/warpage of the sliding closure or the door frame, it may be difficult to keep a door in its fully closed position. Also, in some situations it may be desirable to maintain a door in a particular closed or open position. For example, in triple bypass doors, it is difficult to maintain a middle door in a central position relative to the doors on each side.

It is possible to provide locking devices that mechanically engage the support structure to "lock" the door in a desired position, such as disclosed in U.S. Pat. No. 4,478,006 to Johnson and U.S. Pat. No. 2,064,830 to Hanson. However, these devices require the operator to disengage the mechanical "lock" prior to moving the door, reducing the convenience and desirability of such a closure. Such mechanical locking devices are also readily visible, and thus detract from the appearance of the sliding closure, often a critical feature in the commercial success of a given design. In addition, the incorporation of such a locking device into an existing sliding closure would likely require substantial alteration of the underlying support structure, at attendant additional expense.

Therefore, there is a need in the art for a device to maintain a closure in a selected positions, while still allowing substantially free, unimpeded movement of the door during normal operation. Such device should not be readily visible to the casual observer, so as to not detract from the appearance of the sliding closure assembly, and it should be easy to install in existing facilities.

SUMMARY OF THE INVENTION

In accordance with the present invention, a door parking locator is provided which, when introduced into the support track of a sliding closure, allows the door or other sliding element to be positioned in a desired location, even when the support track has been warped or distorted and/or is not aligned at or near the horizontal plane. Essentially, the door parking locator provides a depression into which a support wheel of the door support fits when the door is in its desired location. Elongated ramps are provided that serve to secure a support wheel in place, ensure smooth operation of the system and to minimize the additional force required of the operator in properly positioning the door in its desired location. Because the door parking locator of the present invention is designed to be inserted into the support track of the sliding closure, and will cause only a minimal disturbance to the door as it passes over the door parking locator, it thereby remains essentially hidden from view by the causal observer.

In one embodiment suitable for use in a bottom support sliding closure, the support wheel for a door normally carries the weight of the door on an inverted generally U-shaped support rib of a support track. When the support wheel reaches the proximity of the door parking locator, the outer edge of the support wheel engages the elongated ramp of the door parking locator, thereby transferring the weight of the door from a concave periphery of the wheel and the support rib to the elongated ramp and the floor of the track. As the door moves further towards a desired location, the support wheel travels up the slope of the elongated ramp. When the door reaches the desired location, the support wheel travels into the depression formed in the door parking locator, which thereby tends to resist further motion of the door. Preferably, the weight of the door is transferred off of the wheel edges and the locator when the wheel is in the depression and back to the wheel central portion and the track rib. When additional movement of the door is desired, the operator need only exert sufficient horizontal force to move the support wheel out of the depression in the door parking locator. The support wheel will then travel freely down the elongated ramp of the door parking locator, eventually transferring the weight of the door back to the support rib of the support track, and operating normally.

By installing various combinations of door parking locators into the support track of a sliding closure assembly, an installer will be able to counteract the effects of poor construction or warping of the support structure while still allowing the sliding closure assembly to operate freely. In addition, the use of multiple door parking locators in a single track as well as the use of multiple door parking locators in multiple track sliding door assemblies will allow the installer to pre-position doors and to improve the versatility and desirability of the sliding closure assembly.

DETAILED DESCRIPTION OF THE PREFERRED EMBODIMENT

Figure 1:
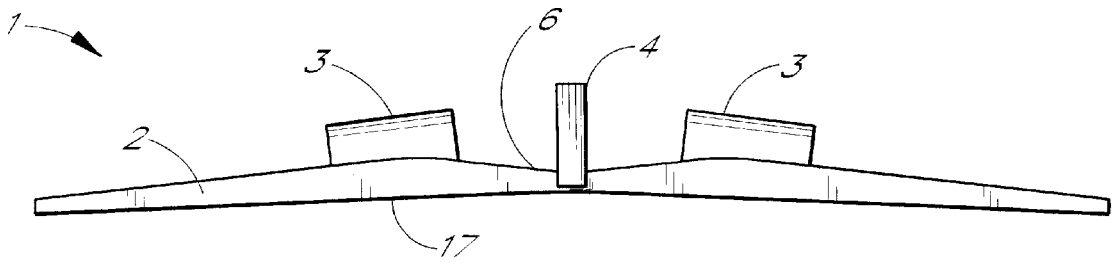
FIG. 1 is a front view of one embodiment of a door parking locator constructed in accordance with the present invention.
Figure 2:
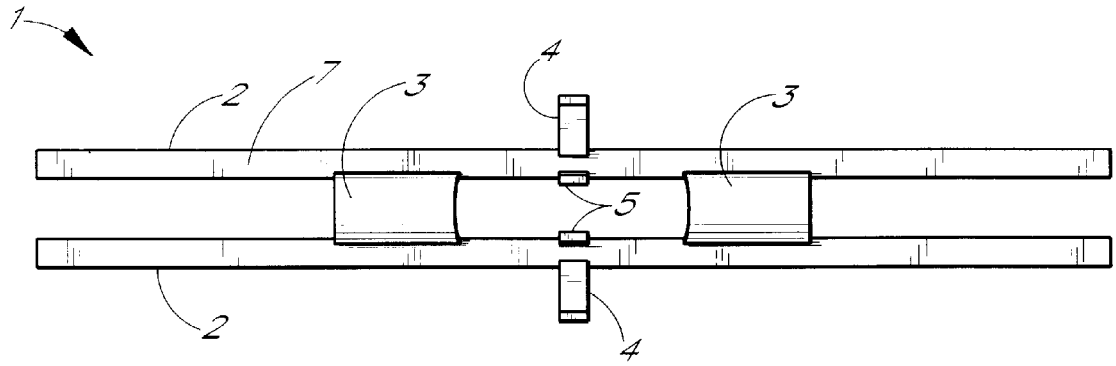
FIG. 2 is a top plan view of the locator of FIG. 1.

FIGS. 1 and 2 illustrate a door parking locator 1 constructed in accordance with the present invention having two parallel elongated support ramps 2 connected by two spaced, generally flat bands or connectors 3 which position and stabilize the support ramps 2 with respect to each other. Flat, outwardly extending flexible tabs or wings 4, connected to an external edge of each support ramp 2, provide lateral support and, as will be described later, serve to secure the door parking locator into a desired position in the support track. Internal rib guides or tabs 5 are connected to an internal edge of the support ramps 2, laterally aligned with the external tabs. A central depression 6 is incorporated into each support ramp 2 between the connectors 3.

In a preferred embodiment, the door parking locator is constructed of acetal, which is commercially available under the product name Delrin or Celcon. Of course, the locator may be constructed of other material, including suitable wood, plastic, or metal.

Figure 3:
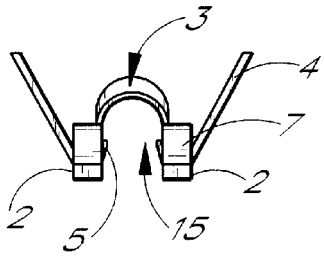
FIG. 3 is a side or end view of the locator of FIGS. 1 and 2.

Referring to FIG. 3, the connector 3 is formed in an arch or arcuate shape, such that a cavity 15 is formed between the support ramps 2. The cavity 15 desirably corresponds to an inverted generally U-shaped support rib 33 (see FIG. 5) of a support track 30, allowing the door parking locator to fit securely into the support track while still providing support and stability for the two ramps 2.

Figure 4:
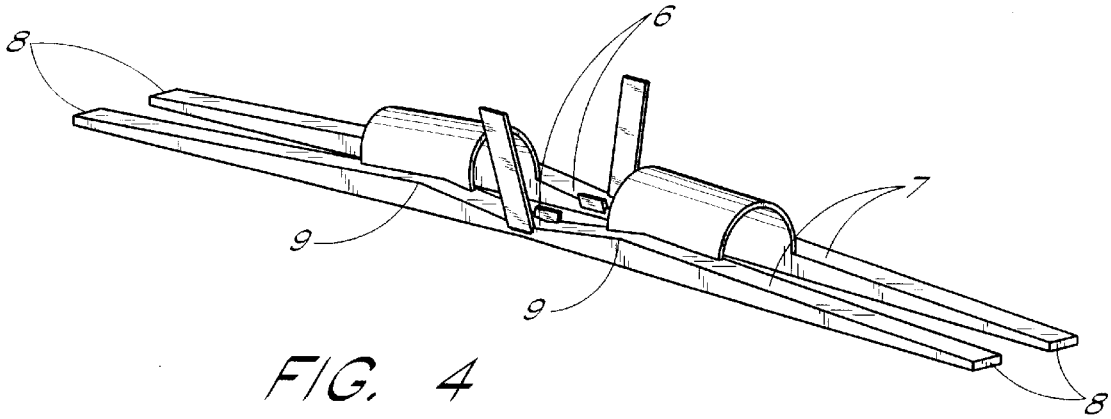
FIG. 4 is an isometric perspective view of the locator of FIGS. 1 through 3.

As can more easily be seen from FIG. 4, the upper surfaces 7 of the two support ramps 2 are inclined, from a lowest point 8 located at the ends of the support ramps 2 to a highest point or line 9 towards the center of the locator 1. The central depression 6 is located between the two highest points 9 in the upper surface 7. It should be noted, however, that the depression 6 need not necessarily be located at the center of the support ramp. The connectors do not extend along the entire length of the support ramps 2. Rather, for reasons that will be described later, the connectors desirably only extend the highest areas 9 of the support ramps.

Figure 5:
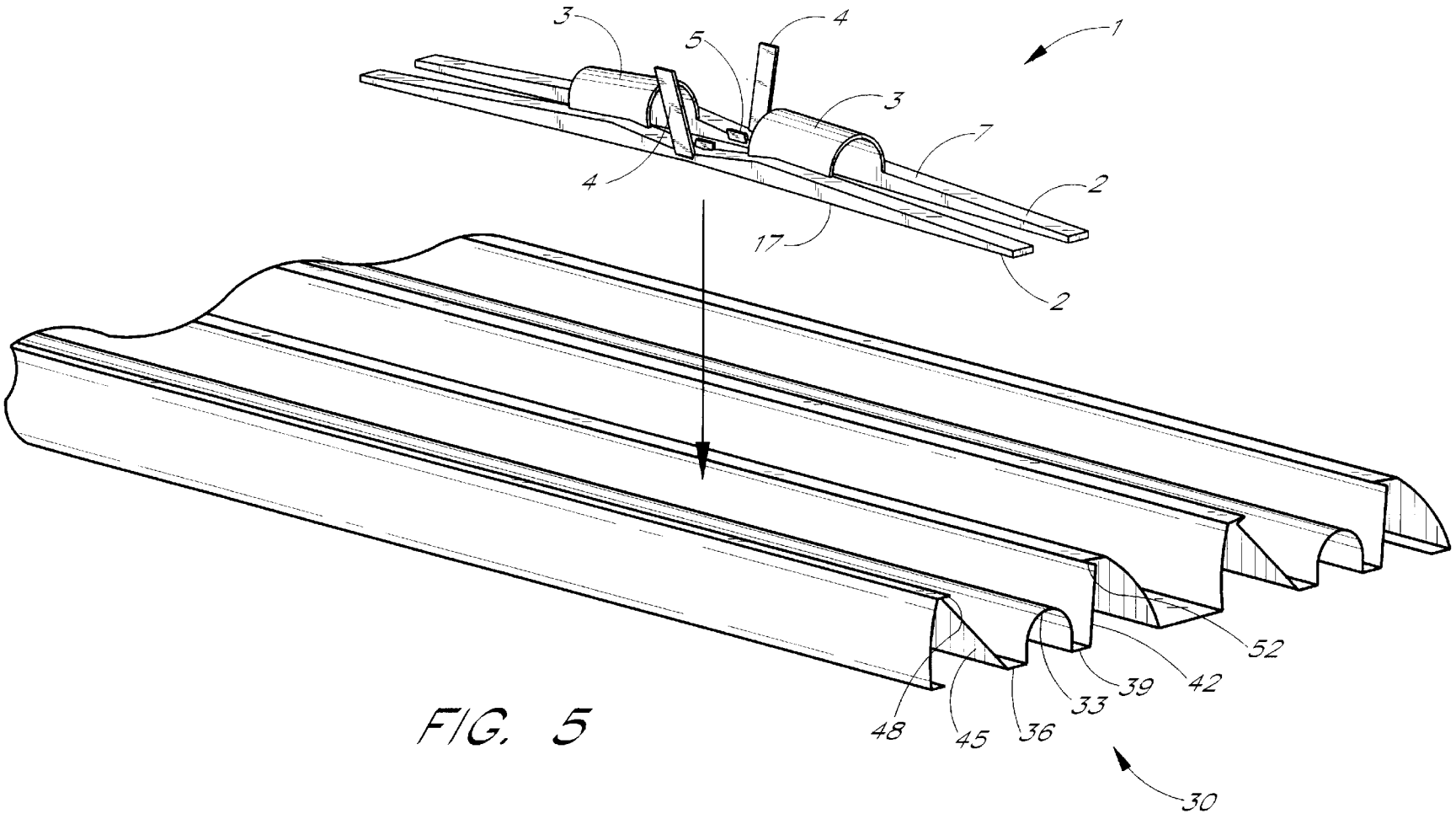
FIG. 5 is an isometric perspective view of the locator prior to insertion of the locator into a support track.

As can be seen from FIG. 5, each support track 30 of the dual-track support structure incorporates an inverted generally U-shaped support rib 33 bordered by two lower horizontal floors 36 and 39, connected to upwardly and outwardly slanted track walls 42 and 45. The edges of the slanted walls 42 and 45 are formed integral with the upper horizontal walls 48 and 52, each of which extends inwardly towards the hub 33 and then is doubled on itself to extend outwardly. The outer edge of each wall 48 and 52 is joined to a downwardly and outwardly extending side slanted wall 49 and 53. Typically, the support track 30 is constructed of sheet steel, or extruded aluminum.

Figure 6:
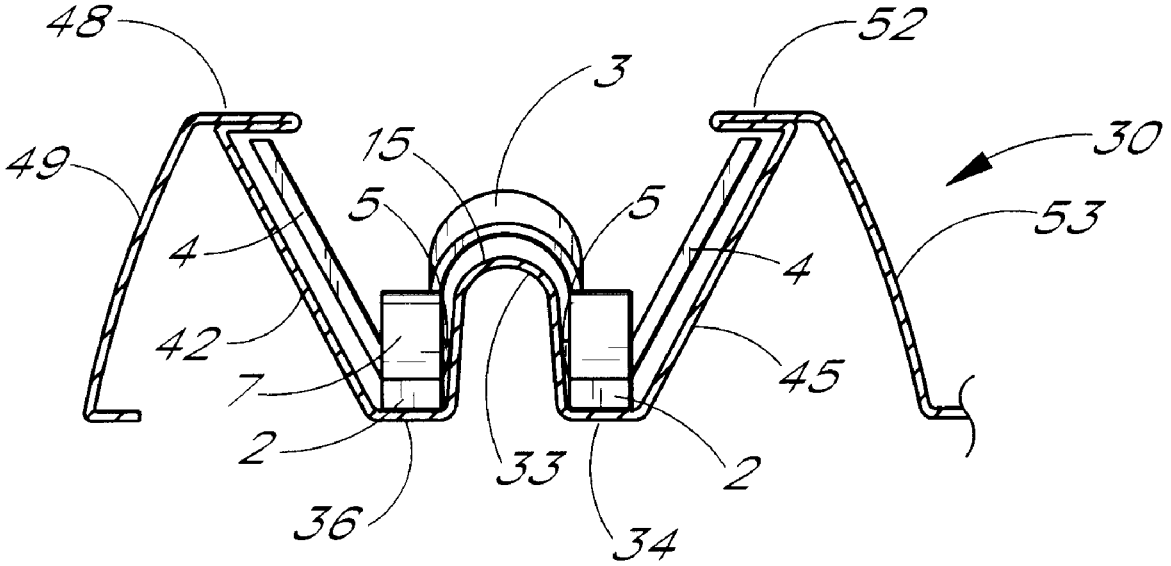
FIG. 6 shows a cross-sectional view of the track of FIG. 5, showing the locator installed.

FIG. 6 shows the door parking locator 1, positioned in the support track 30, secured in place by the interaction of external wings 4 with the overlapping walls 48 and 52 of the support track 30. The width between walls 48 and 52 is less than the width between the outer ends of flexible wings 4. Hence, upon insertion of the locator into the support track, the wings 4 must flex inwardly a sufficient amount to allow the locator to bypass walls 48 and 52. When the locator is in its desired location in the support track, the flexible wings 4 will have sufficient clearance to snap to their unrestrained, original shape. This allows the upper ends of the wings 4 to be confined by the walls 48 and 52, preventing the door parking locator from traveling upwardly out of the support track.

As can be seen, the support rib 33 fits into the cavity 15 beneath the arcuate connector 3. The distance between the rib tabs 5 is slightly less than the width of the track rib 33. Thus, the tabs engage and lightly grip the rib to help position the locator. In the preferred embodiment, the locator ramps are constructed so that two halves of a ramp form a shallow angle in its free state so that the ends 8 of the locator are slightly lower in relation to the center of the bottom surface 17. This allows the central portion of the locator to be pressed against the support track when the locator is inserted, and allows the wings 4 to clear the inner edges of the track walls 48 and 52. When released, the flexibility of the locator and the tabs 5 causes it to move the wings upwardly slightly to be captured beneath the walls 48 and 52 to help secure the locator in its desired position. If desired, a commercial adhesive, such as cyanoacrylate (commercially sold as Super Glue™), silicone or rubber cement, among others, may be used to secure the locator to the track floors 36 and 39.

Figure 7:
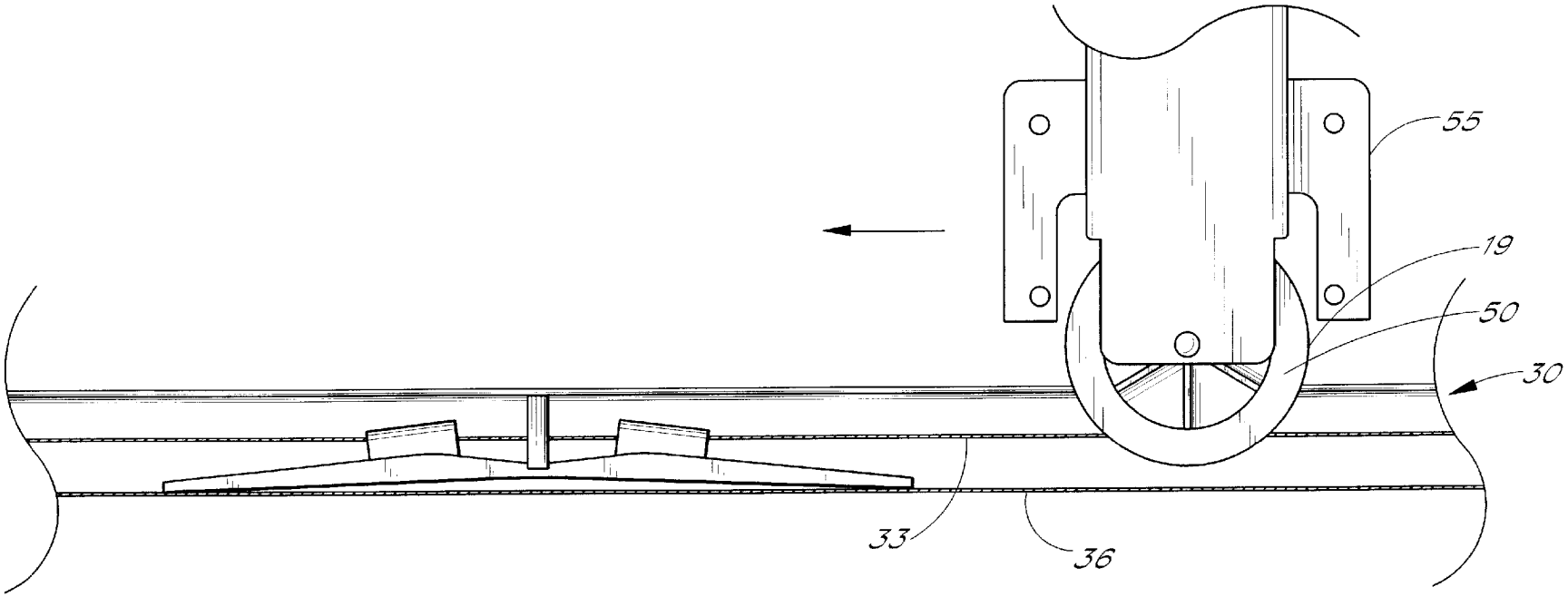
FIG. 7 shows a front view of FIG. 6, with a support wheel of a door traveling in the support track.

Referring to FIG. 7, a support wheel 50 is connected to a wheel support structure 55, which bears the weight of a sliding door (not shown). As seen, the outer edges 19 of the support wheel 50 are not in contact with the floors 36 and 39 of the support track 30. Rather, the edges are spaced from the floors and the concave periphery 60, FIG. 10, of support wheel 50 is in contact with and travels on the track rib 33. Thus, the weight of the door is primarily supported by the rib 33 and the strong central part of the wheel. However, the wheel edges are about to engage the upper surface of the ramps. As can be seen from this figure, the outer edges 19 of the wheel 50 initially contact the inclined upper surface 7 of the door parking locator 1 at a location between the low end point 8 and the load transfer peak 9 of the support ramp 2. This allows the wheel to smoothly roll on to the locator.

As the wheel travels further along the locator 1, the ramp inclined upper surface 7 will lift support wheel 50 off the support rib 33 on which it normally travels. This will transfer substantially all of the weight of the door from the support rib 33 to the outer edge 19 of the wheel. The inclined surface is desirably constructed at a very small angle from the horizontal, so as not to substantially impede the progress of the sliding door assembly. In a preferred embodiment, the inclined surface is constructed at about a 3 to 5 degree angle.

Figure 8:
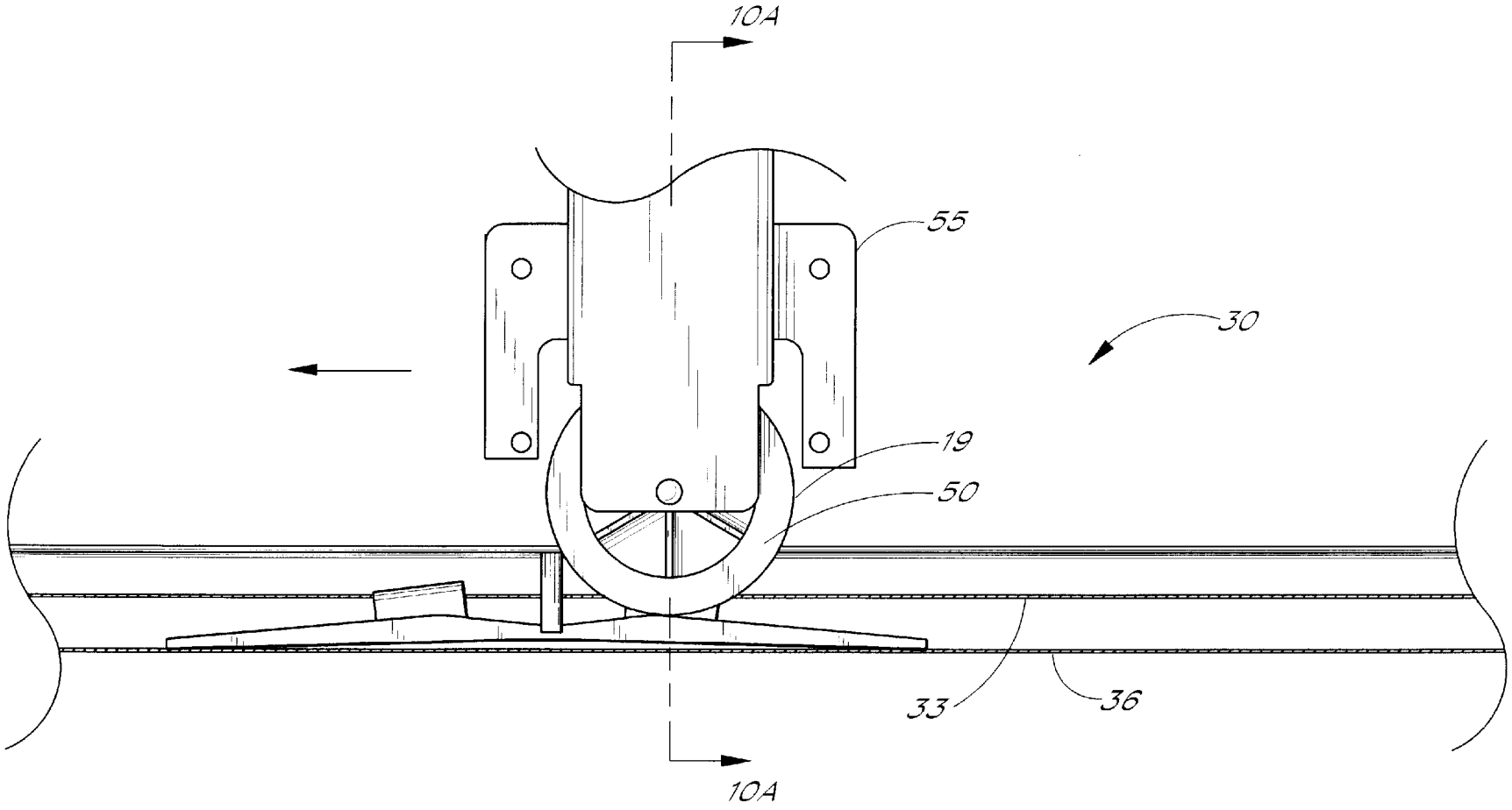
FIG. 8 shows a front view of the door support wheel on the locator at the load transfer peak.

Once sufficient weight is transferred from the support rib 33 to the locator, the locator will slightly flatten, allowing the bottom surface 17 of the door parking locator to fully contact the track floors 36 and 39. This deformation causes the connectors 3 to move slightly downward towards the track rib 33 into more of a horizontal orientation. The lifting of the wheel allows the wheel to freely travel over the connectors 3 as the wheel continues to travel from right to left, thereby preserving the smooth, substantially unimpeded motion of the door. The connectors are located at the highest points or load transfer peaks 9, along the support ramps 2 so that the wheel is at its greatest height above the support rib 33 when it passes over the connectors 3, as seen from FIGS. 8 and 10*a*. In a preferred embodiment, the connectors extend along the ramps a little less than half an inch. This length provides adequate connecting strength for the ramps while minimizing the raising of the wheel to clear the connectors.

Figure 9:
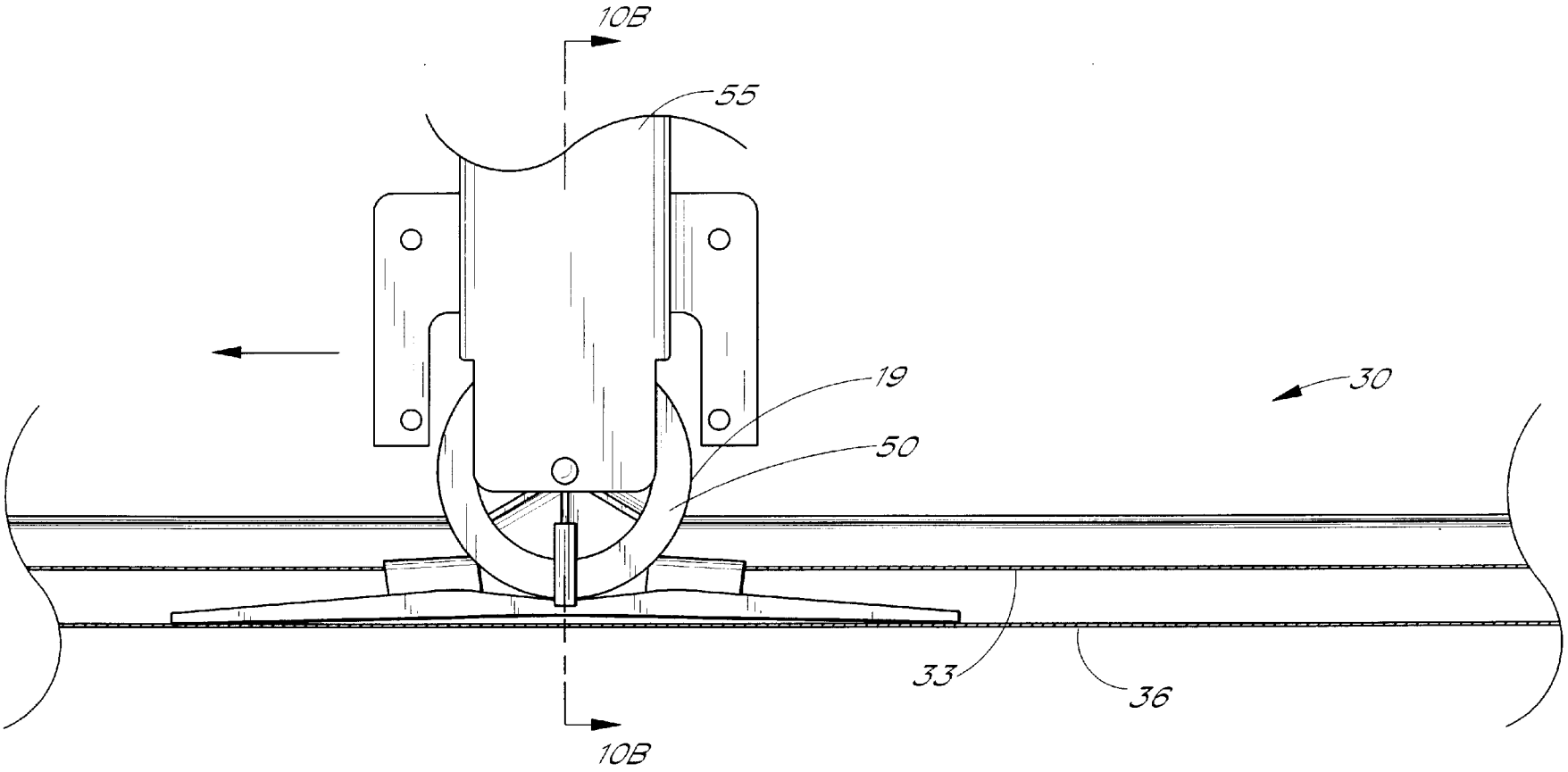
FIG. 9 shows the door support wheel in the depression of the door parking locator.
Figure 10B:
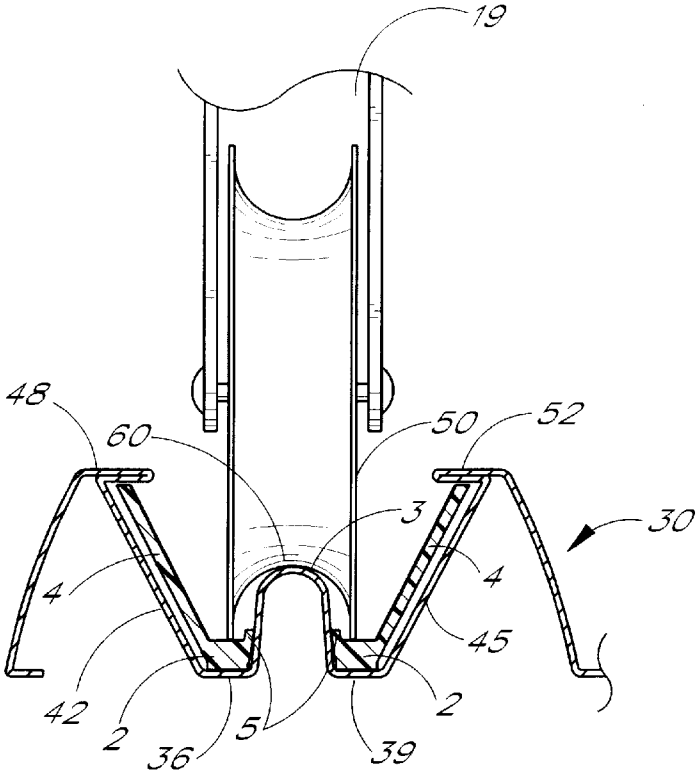
FIG. 10*b* is a cross-sectional view on line 10*b*—10*b* of FIG. 9 showing the wheel located in the depression in the center of the locator.
Figure 10A:
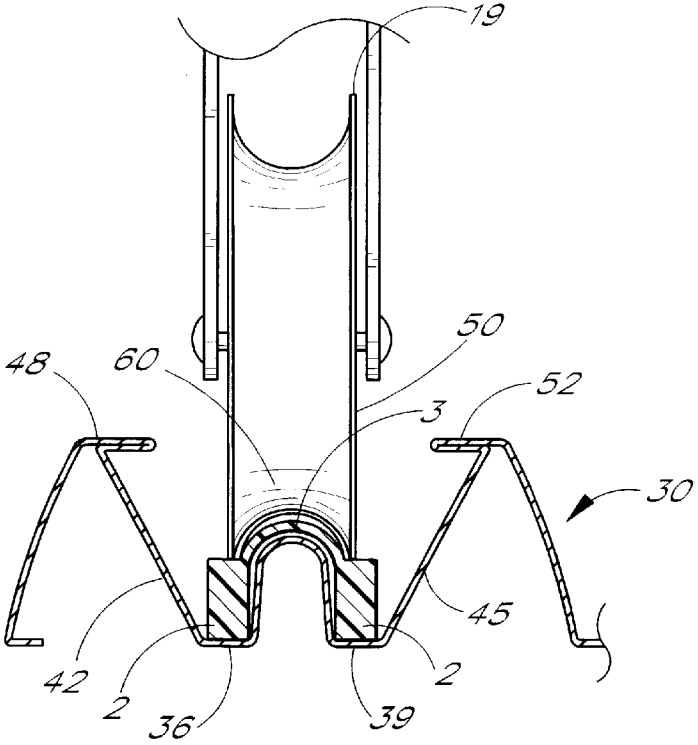
FIG. 10*a* is a cross-sectional view on line 10*a*—10*a* of FIG. 8.

FIGS. 9 and 10*b* show the support wheel 50 having travelled into the depression 6 of the locator. In this position, the gravitational pull on the door, coupled with the downwardly sloping sides of the sides of the depression 6 create a restraining force that tends to maintain the support wheel 50 within the depression 6, thus maintaining the door in the desired location. In order to further move the door, an external force equal to or greater than this restraining force must be applied to the door, thereby inducing the support wheel 50 out of the depression 6 and allowing the door to once more travel freely down the support ramps 2 and onto the support track 30. The sides of the depression 6 form a very shallow angle that defines a radius of curvature greater than the radius of the support wheel 50 so as to provide smooth wheel movement.

From FIG. 10*b*, it can be seen that the concave surface 60 of support wheel 50 is once more engaging the track rib so that the load is once more distributed on the concave central potion of the wheel rather than on the thin edges of the wheel. While the upward bias of the locator may cause the ramps to engage the wheel edges, there is preferably no significant load on the wheel edges. This is important for wheels with thin edges because the load per square inch of a heavy door is quite high. The temporary load on the edges when the wheel is moving onto or off of the ramps is acceptable, but a sustained load for a long period might cause breakage of the wheel edges.

Figure 11:
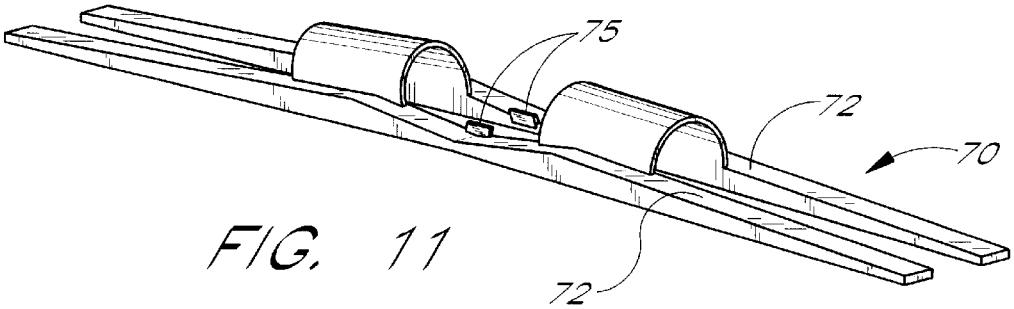
FIG. 11 is a perspective view of the locator of FIG. 4 with the two wings removed.
Figure 14:
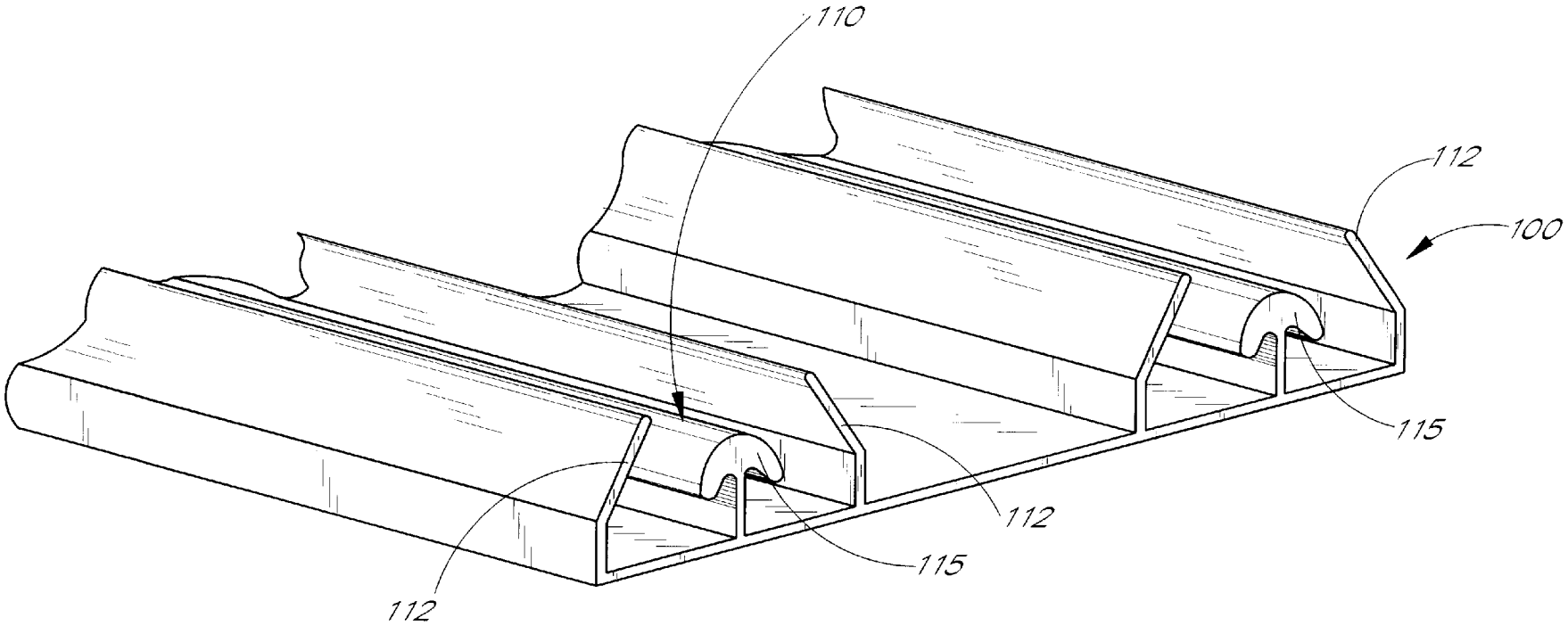
FIG. 14 is an isometric perspective view of an alternate support structure for a sliding door assembly.

FIG. 11 shows an alternate embodiment of a door parking locator 70 for use in an another commonly utilized type of support track 100, best shown in FIG. 14. The locator is the same as that of FIGS. 1–4 except that the wings 4 have been removed. The track 100 utilizes the same basic operational concepts as the support track of FIG. 5, but is typically formed by an extrusion process and incorporates a different central support member. In place of the inverted, generally U-shaped rib described earlier, track 100 utilizes a generally mushroom-shaped rib 110 upon which travels the central support wheel 50 for a sliding door assembly. The track sidewalls 112 would interfere with the wings of the locator of FIGS. 1–4.

Figure 15:
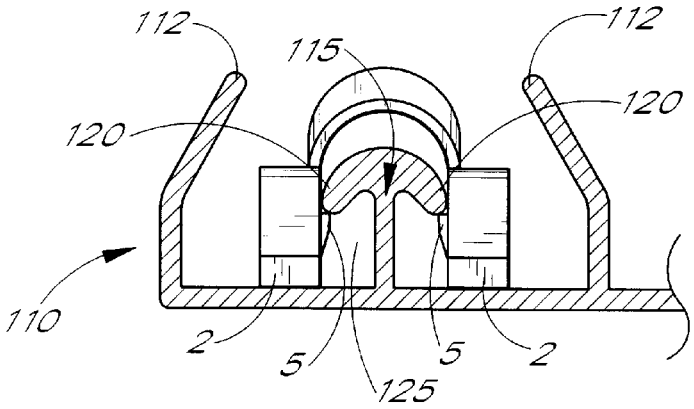
FIG. 15 is a cross-sectional view of the support structure of FIG. 14, after installation of the door parking locator of FIG. 11.

Because the door parking locator 70 of FIG. 15 is made of a flexible material, the internal tabs 75 on the ramps 72 of the door parking locator 70 will deform around the mushroom head 4 of the rib 110. The tabs then will snap back to their original unrestrained position. Because the width of mushroom head 115 is greater than the gap between the internal tabs 75, they are captured beneath the mushroom head 115, thereby securing the door parking locator into its desired position in the mushroom track.

Figure 12:
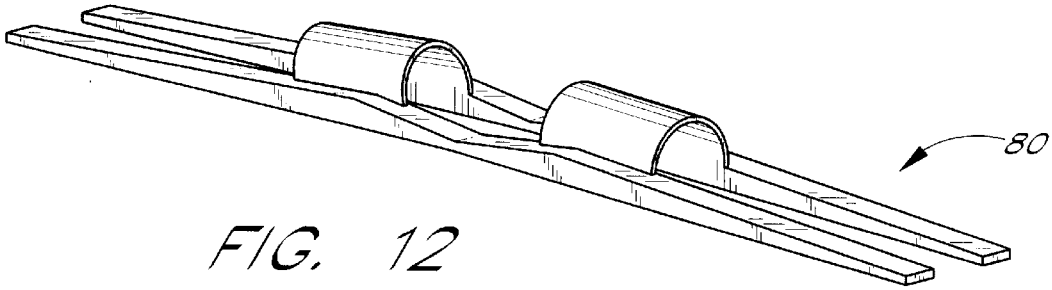
FIG. 12 is an isometric perspective view of the locator of FIG. 4 with both the wings and the inner tabs removed.

FIG. 12 shows another alternate embodiment of a door parking locator 80, which does not incorporate the external wings 4 or the internal tabs 5 of the embodiment depicted in FIG. 4. Because alternate designs of support tracks or the use of adhesives may prevent the use of or obviate the need for such wings or tabs, they may be removed by the installer, or initially formed as depicted in FIG. 12.

Figure 13:
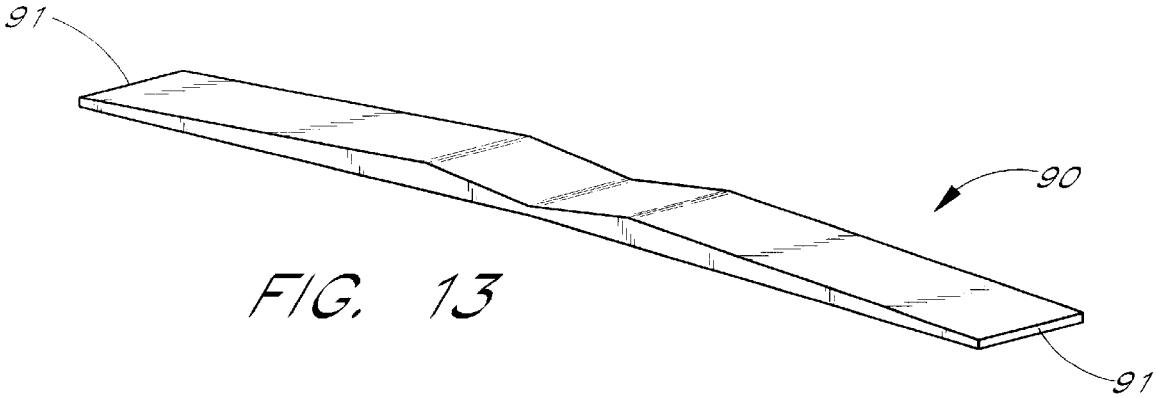
FIG. 13 is an isometric perspective view of another alternate embodiment of a door parking locator constructed in accordance with the present invention.
Figure 16:
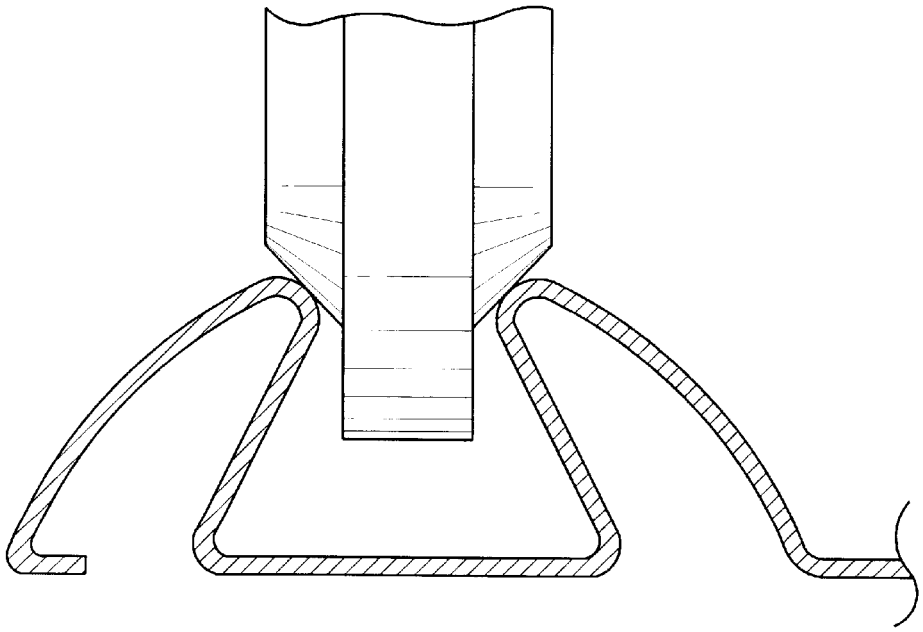
FIG. 16 is an isometric perspective view of a support track which can receive the locator of FIG. 13.

FIG. 13 shows another alternate embodiment of a door parking locator 90, which is best suited for use with a sliding door support track that does not incorporate a support rib or other protruding structure in the support surface. For this type of support track, the outer surface of the support wheel is typically flat or convex, rather than concave, and thus a door parking locator comprised of a single support ramp is adequate. Because the support wheels in this type of support track remain in constant contact with the lower surface of the support track, the ends 91 of the door parking locator preferably incorporate a beveled edge which will minimize any interference with the smooth operation of the sliding door. While this embodiment is best suited for installation into a support track utilizing flat or convex support wheels, such as the convex support track depicted in FIG. 16, it may be utilized in other sliding closure assemblies.

Although the door parking locator assembly has been shown in connection with a vertically supported sliding panel fixture, the present invention may be adapted to sliding fixtures supported from a hanging track as well as fixtures which travel vertically and are supported on vertical walls. In such vertical traveling fixtures, the biasing force may be produced by such devices as spring loaded fixtures, rather than relying upon the gravitational attraction on the sliding fixture to produce the normal force.

Although this invention has been disclosed and described in the context of certain preferred embodiments, it will be understood by those skilled in the art that the present invention extends beyond the specific disclosed embodiments to other alternative embodiments of the invention. Thus, it is intended that the scope of the present invention herein disclosed should not be limited to the particular disclosed embodiments described above, but should be determined only by a fair reading of the claims that follow.

What is claimed is:

1. A closure parking locator for use with a sliding closure having an elongated support track for receiving a wheel of said closure, comprising an elongated member having a length greater than a transverse width and being formed to fit lengthwise into said track, said member having a wheel lifting top surface, a first end and a second end spaced along the direction of motion of the wheel in the track, and a depression between said ends to capture said wheel, said top surface having a first low point near said first end and a first high point between said first end and said depression, the horizontal distance between the first low point and the first high point being greater than the vertical distance between the first low point and the first high point, said top surface further having a second low point near said second end and a second high point between said second end and said depression, at least a portion of the top surface between said first low point and said first high point being inclined and at least a portion of the top surface between said second low point and said second high point being inclined.

2. The locator of claim 1, wherein said inclined wheel lifting surface between said first end and said depression extends from said first end to said first high point.

3. The locator of claim 1, wherein at least a portion of the inclined top surface between said first low point and said first high point is inclined less than 25° relative to a longitudinal axis of the support track.

4. The locator of claim 3, wherein the inclined top surface is a flat, planar surface.

5. The locator of claim 1, wherein at least a portion of the inclined top surface between said first low point and said first high point is inclined less than 25° relative to the bottom surface of the locator.

6. A door parking locator for use with a sliding door having a support track with an inverted, generally U-shaped support rib, comprising:

a pair of laterally spaced elongated ramps separated by a cavity sized to receive said rib, each of said ramps sized to fit within a groove in said support track adjacent said rib, said ramps each having a top surface, a bottom surface, a first end and a second end, said ramps each having a depression located between said ends, the thickness between said top and bottom surfaces at a location between said first end and said depression is greater than the thickness between said top and bottom surfaces at said first end and said depression of each ramp, and said ramps being joined by at least one connector extending between the ramps and formed to fit over said rib.

7. The locator of claim 6 including a flexible wing extending outwardly from each of said ramps, each wing being adapted to fit within a recess in said track to retain said locator in the track.

8. The locator of claim 6 including a short tab extending inwardly from each ramp towards the opposite ramp, such that at least a portion of said short tabs extends between said laterally spaced ramps.

9. The locator of claim 8, wherein a gap between the tabs is less than the width of the rib so that the tabs engage the sides of said track rib to help retain said locator in the track.

10. A door parking locator for use in a sliding door support track for receiving a supporting wheel of the door, the track having an elongated rib and a groove on each side of the rib, the rib being adapted to be engaged by a central, concave periphery of the wheel, with edges of the wheel extending into the grooves, but being spaced slightly above the bottom of the grooves so that the load of the door is borne by the concave portion, said locator comprising:

a pair of laterally spaced, elongated ramps adapted to fit within said grooves, the ramps sloping along a direction of travel of the wheel in the track;

each ramp having an upper surface that slopes upwardly from opposite ends of the ramp toward a pair of spaced load transfer peaks and then slopes downwardly to a depression between said peaks, the height of said ramps being selected so that said wheel can ride onto said ramps from either end to cause the load supported by said wheel to be gradually transferred from said rib to said ramps by way of the wheel edges engaging said ramps as the wheel moves toward one of said peaks on each ramp, and the height of said depression being selected so that the wheel is captured therein when rolled between the peaks.

11. The locator of claim 10, wherein the depression is dimensioned such that the load borne by said wheel is transferred from the ramps and the wheel edges back to the rib as the wheel moves into said depression.

12. The locator of claim 10 including at least one connector joining said ramps and formed to fit over said track rib.

13. The locator of claim 12, wherein said connector is located in the area of a load transfer peak so that said wheel can move over said connector without significant load being applied to the connector.

14. The locator of claim 13, wherein said connector is in the form of a flat band having a generally inverted U-shaped cross section, and opposite ends of said connector are joined to inner edges of said ramps so as not to interfere with the edges of said wheel when moving on said ramps adjacent said connector.

15. The locator of claim 10 including a pair of spaced connectors joining said ramps, said connectors being adapted to fit over said track rib, with each connector being respectively connected to the ramps in the location of said load transfer peaks.

16. The locator of claim 10 including an outwardly extending wing formed on the outer edge of each of said ramps in the area of said depression, each wing being adapted to snap within a recess in said track to help retain the locator in the track.

17. The locator of claim 16, wherein each of said ramps has a short tab formed on the inner edge of each ramp in the area of said depression to engage said rib.

18. The locator of claim 10 including a short, inwardly extending tab on the inner edge of each ramp to engage a recess in said track rib to retain the locator in said track.

19. A door parking locator for insertion into a support track for receiving a wheel of a sliding door comprising:

at least one elongated support adapted to fit within said track;

said support including longitudinally spaced means for elevating said wheel and then lowering said wheel into a depression located between said elevating means to capture said wheel between said elevating means.

20. The locator of claim 19, including a pair of said supports; and means for connecting said supports formed to extend over a wheel supporting rib in said track.

21. The locator of claim 20, wherein said elevating means is formed to shift the load on said wheel from a central concave portion to wheel edges when said wheel is moving over said connecting means.

22. A method of parking a door in a support track at a desired location yet still allowing for normal movement of said door into and out of said location when an operator so desires, comprising:

inserting a door parking locator at a desired position for said door into said track, the locator including a depression formed in an upper surface of said locator and a pair of laterally spaced ramps which fit within grooves in said support track; and rolling a support wheel of said door up an inclined surface of said ramps and then downwardly into the depression in said upper surface to capture the wheel in the depression.

23. The method of claim 22, wherein said inserting step includes pushing said locator into the track in a manner to flex inwardly free ends of a pair of outwardly flaring flexible wings on the locator to allow the wings to move into the track and snap outwardly into adjacent recesses in the track to capture the locator in the track.

24. The method of claim 22, further comprising:

prior to said inserting step, separating a pair of outwardly flaring flexible wings on the locator from the locator, wherein said inserting step includes pushing said locator into the track in a manner to cause short inwardly extending tabs to flex away from a central rib of said track and then snap into a recess in said rib to capture the locator in the track.

25. A securing device for use with a sliding closure comprising a support track for receiving a wheel of said closure and an elongated member formed to fit into said track, said member having a wheel lifting top surface, a first end and a second end spaced along a direction of motion of said wheel, and a depression between said ends to capture said wheel, said wheel lifting top surface having a first low point near said first end, a first high point between said first end and said depression, a second low point near said second end and a second high point between said second end and said depression, with at least a portion of the top surface between said first low point and said first high point being inclined and at least a portion of the top surface between said second low point and said second high point being inclined.

26. The securing device of claim 25, wherein the top surface has a first low point near said first end and a first high point between said first end and said depression, the horizontal distance between the first low point and the first high point is greater than the vertical distance between the first low point and the first high point.

27. The securing device of claim 25, wherein the support track comprises an elongated rib and a groove on each side of the rib, the rib being adapted to be engaged by a central, concave periphery of the wheel, with edges of the wheel extending into the grooves.

28. The securing device of claim 27, wherein the elongated member further comprises a plurality of laterally spaced elongated ramps and said ramps are sized to fit into said track.

29. The securing device of claim 28, wherein said ramps are joined by at least one connector extending between the ramps and formed to fit over said rib.

* * * * *